United States Patent [19]

Goussios

[11] 4,237,617

[45] Dec. 9, 1980

[54] POLYTRACK OPTO-DIGITAL DRAFTING MACHINE

[76] Inventor: Constantine C. Goussios, 37 Chafee Ave., Albertson, N.Y. 11507

[21] Appl. No.: 9,421

[22] Filed: Feb. 5, 1979

Related U.S. Application Data

[63] Continuation-in-part of Ser. No. 883,631, Mar. 6, 1978, abandoned, which is a continuation-in-part of Ser. No. 766,877, Feb. 9, 1977, Pat. No. 4,121,344.

[51] Int. Cl.[3] ..... B43L 7/00

[52] U.S. Cl. ..... 33/427; 33/1 M; 33/125 C; 33/141 E

[58] Field of Search ..... 33/1 M, 125 C, 125 M, 33/141 R, 141 E, 403, 430, 436, 447, 449, 476, 484, 485, 489, 494, 427, 450

[56] References Cited

U.S. PATENT DOCUMENTS

| | | | |
|---|---|---|---|
| 1,010,664 | 12/1911 | Melick | 33/450 |
| 1,057,583 | 4/1913 | Schenk | 33/450 X |
| 1,213,664 | 1/1917 | McCuaig et al. | 33/447 |
| 3,449,833 | 6/1969 | Dzula | 33/1 M |
| 3,688,410 | 9/1972 | Zeidler et al. | 33/125 M |
| 3,757,422 | 9/1973 | Frydenberg | 33/430 |
| 3,973,326 | 8/1976 | Gallacher et al. | 33/1 M |
| 4,008,523 | 2/1977 | von Voros | 33/125 C |

FOREIGN PATENT DOCUMENTS

| | | | |
|---|---|---|---|
| 338648 | 6/1921 | Fed. Rep. of Germany | 33/110 |
| 911950 | 12/1962 | United Kingdom | 33/125 M |

*Primary Examiner*—Charles E. Phillips
*Attorney, Agent, or Firm*—Constantine A. Michalos; Peter C. Michalos

[57] ABSTRACT

A digital drafting machine for measuring and displaying a distance on a drafting surface comprising a first triangle with a vertical straight edge and a second triangle with a horizontal straight edge slidably engaged with the first triangle along the vertical straight edge. A drive in the form of a drive wheel and pulleys with a cable rapped therearound disposed in the first triangle with the cable connected to the second triangle, the drive wheel being rotatable to displace the second triangle with its horizontal straight edge along the vertical straight edge of the first triangle. An optical horizontal displacement measuring device is connected to the first triangle and includes a light sensor for sensing the passing of the drawing surface to measure the linear displacement of the first triangle when it is drawn horizontally across the drawing surface. An optical vertical displacement measuring device is connected to the second triangle and includes a light sensor for sensing the relative movement between the second triangle and first triangle and measuring the displacement of the second triangle along the vertical straight edge of the first triangle when the drive wheel is rotated. An electronic digital display is connected to the horizontal and vertical displacement measuring devices to display the horizontal and vertical displacements of the vertical and horizonal straight edges respectively.

13 Claims, 6 Drawing Figures

POLYTRACK OPTO-DIGITAL DRAFTING MACHINE

BACKGROUND OF THE INVENTION

1. Field of the Invention

This is a continuation-in-part of the inventor's previous application filed Mar. 6, 1978 with Ser. No. 883,631 entitled POLYTRACK DIGITAL SCALE, now abandoned, which itself is a continuation-in-part of the inventor's previous application filed Feb. 9, 1977 entitled UNIVERSAL DRAFTING TRIANGLE with Ser. No. 766,877 now U.S. Pat. No. 4,121,344.

The present invention refers in general to drafting tools and in particular to a new and useful optical digital measuring device for visually displaying the displacement of a verticle straight edge and a horizontal straight edge of the device over a drafting surface.

2. Description of the Prior Art

In the inventor's previous applications for the UNIVERSAL DRAFTING TRIANGLE and POLYTRACK DIGITAL SCALE, both of which are incorporated by reference in this application, there is described a drafting aid which replaces the functioning of a T-square and triangle arrangement of the conventional drafting table with a single integrated unit which comprises a first right triangle member which can be placed upon and be slid along a conventional T-square or parallel straight edge which is provided on most modern drafting tables. This first triangle provides a vertical straight edge which can be utilized in a conventional manner to draw vertical parallel lines on a drafting surface. A second triangular member is engaged with the first triangle and slidable along its vertical edge. A drive means which comprises a hand operable wheel is mounted in the first triangle and connected to the second triangular member so that a draftsman may manipulate the drive wheel by rotating it in one direction or the other, thereby raising or lowering the second triangular member with respect to the first triangle. The top edge of the second triangular member is provided in parallel orientation to the T-square or parallel straight edge on the drafting table and through the manipulation of the drive wheel, a draftsman using one hand can raise or lower the straight edge of the second triangular member and draw a series of parallel horizontal lines. The entire system, therefore, enables a draftsman to draw horizontal as well as vertical parallels using one hand to engage, hold and manipulate the device, and thereby leave the other hand to do the actual drawing. The UNIVERSAL DRAFTING TRIANGLE therefore provides a single drafting tool that reduces the amount of manipulation required in aligning various drafting tools which were previously required to draw any number of lines on a drafting surface.

As with any conventional drafting tool the UNIVERSAL DRAFTING TRIANGLE can be provided with scaled markings to indicate distances on both its horizontal and vertical straight edges. By reading off markings a draftsman can, in a conventional manner, mark off, for example, equally spaced vertical or horizontal lines. Such a conventional method of marking positions on a drafting surface results in eye strain as well as opens the door to incorrect interpretations of markings and graduations on the scalewhich are unavoidable after long hours of drafting. Further complications arise when the scale on a drawing must be changed or where a drawing must be made from other drawings of a different scale. At the present time draftsmen are also faced with the conversion of changing drawing scales from the English measuring system to the metric system. Although such a conversion requires a simple multiplication of one unit of measure by the other, such a conversion results in the numerical values of distances and scales being entirely different in one system from that in another. A draftsman, therefore, loses any simple relationship he might be able to utilize in converting a drawing from one system to the other. For example, a drawing which must be reduced in scale from one inch equals one foot to $\frac{1}{4}$ inch equals one foot can simply visualize the conversion by quartering any measurement he takes from the drawing to be copied. When converting from English to metric, however, the draftsman must multiply his English measurements by a fractional number which at best is approximate and which is difficult if not impossible to visualize quickly.

In the previous application entitled POLYTRACK DIGITAL SCALE, the object was to overcome difficulties of scaling which were inherent in any drafting tool which utilized a standard ruled scale for measuring distances. A digital display unit was incorporated in the UNIVERSAL DRAFTING TRIANGLE's structure for giving out a digital reading of horizontal and vertical displacements of the elements in the triangle. This was accomplished by providing two precision potentiometers one, directly or indirectly connected to the drive wheel and the other connected to a roller which was engagable with a drafting surface so that the roller would rotate with the horizontal movement of the large triangle as it was drawn across the surface. Digital volt meters where connected to both potentiometers and in turn were connected to respective X and Y display units for displaying a digital number corresponding to the horizontal distance traveled by the drafting tool and the vertical displacement of the second or smaller triangle with respect to the first or larger triangle.

SUMMARY OF THE INVENTION

The present invention is a still further improvement of the UNIVERSAL DRAFTING TRIANGLE and the POLYTRACK DIGITAL SCALE which utilizes light sensors or photosensors used in conjunction with rules strips of tape or rules areas on the drafting tool to give a direct reading of distance displacement and display this reading in the form of a digital measured value. This structure realizes greater advantages over the UNIVERSAL DRAFTING TRIANGLE and the POLYTRACK DIGITAL SCALE since a digital read out is given of the measured values and the number of moving parts and mechanical complexities is reduced to a minimum.

According to one feature of the invention, a first triangle which is preferably in the form of a right triangle having one vertical straight edge, includes a drive roller positioned near an angle of the triangle opposite the straight edge and two idler pulleys or rollers each situated at the remaining two angles of the triangle. A belt preferably in the form of a cable is rapped around the drive roller and the two idler pulleys to form an endless belt structure. A slide is connected to the belt at a location adjacent to the straight edge of the first triangle and the second triangle is connected to the slide member. The second triangle includes one horizontal straight edge which is substantially perpendicular to the vertical straight edge of the first triangle and the second triangle is slidable along the vertical straight edge of the first triangle by rotating the drive wheel and thereby displacing the belt upwardly and downwardly long the vertical straight edge of the first triangle. A first photosensor or lightsensor is embedded in the slide member and faces a flat surface of the first triangle. Closely spaced ruled markings are provided on the first triangle which are distributed in a row corresponding to the path of the light or photosensor. The photosensor is oriented to face the rulled markings and circuitry is connected to the photosensor for counting the passage of the closely spaced rule markings. The number of ruled markings passed by the photosensor is a direct reading of the distance traversed by the second triangle along the vertical straight of the first triangle.

For reading a horizontal displacement of the first triangle on the drafting surface, two separate embodiments are disclosed. First embodiment utilizes a second light or photo sensor which is embeded near the base of the first triangle and oriented to face the drafting surface. The drafting surface or a straight edge used in conjunction with the drafting surface is provided with a tape structure which includes closely spaced ruled markings. The tape may be provided with an adhesive for easy connection to the drafting surface or the straight edge of a straight edge tool used in conjunction with the inventive drafting machine. The tape should be of a nonstretching material such as, for example, Mylar tape so that the spacing between ruled markings is not changed. As the large or first triangle is moved horizontally along the straight edge tool, the second light sensor senses the passing of the ruled markings on the tape and gives a direct reading of the distance traversed by the first triangle in the horizontal direction.

An alternate embodiment of the horizontal measuring device comprises a rotatably mounted roller or wheel which is rotatably mounted in the first triangle and has a periphery abuttable with the drafting surface. The roller is adapted to rotate with a horizontal displacement of the first triangle along the drafting surface. An optical sensing element, commonly referred to as a shaft encoder, is connected to the roller for converting the rotation of the roller into digital information for providing digital display of the horizontal displacement of the first triangle on the straight edge tool. Shaft encoders commonly comprise a photosensitive element which faces a disc member having radially extending circumferentially spaced rule markings so that the photosensitive element will count the passage of the ruled markings as the disc rotates.

Accordingly, an object of the present invention is to provide a digital drafting machine for measuring and displaying a distance on a drafting surface comprising, a first triangle with a vertical straight edge, a second triangle with a horizontal straight edge having an adjacent edge slidably engaged with said first triangle along said vertical straight edge, a drive wheel rotatably mounted in said first triangle, cable guide means in said first triangle spaced from said drive wheel, a cable engaged around said drive wheel and cable guide means having at least a portion coextensive with a portion of said vertical straight edge and adjacent thereto, said drive wheel rotatable to vertically move said cable portion, a slide member connected to said cable portion adapted for movement in a path in said first triangle and along said vertical straight edge, said second triangle connected to said slide member, a first plurality of spaced ruled markings distributed along said first triangle adjacent said vertical straight edge and in the path of said slide member, first photosensor means in said slide member facing said first plurality of spaced ruled markings for sensing the passing of said ruled markings with respect to said slide member, second photosensitive means in said first triangle facing the drafting surface, a second plurality of spaced ruled markings distributed along a horizontal row on the drafting surface associated with said first triangle, said first triangle positionable with said second photosensor means facing said second plurality of ruled markings, said first triangle movable horizontally and said second sensor adapted for sensing the passing of said second plurality of ruled markings, digital circuit means connected to said first and second photosensor means for converting said sensed passings of said respective ruled markings, and a digital display connected to said digital circuit means for displaying a digital numeral corresponding to the passings of said respective ruled markings.

A further object of the present invention is to use the ruled markings that are photosensor for sensing the vertical displacement of the second triangle with respect to the first triangle and a roller connected into the first triangle and engagable with the drafting surface which is connected to a shaft encoder for converting the rotation of the roller into digital impulses convertible into a digital display for displaying the vertical displacement of the first triangle on a drafting surface.

A still further object of the present invention is to provide a polytrack optical digital drafting maching which is simple in design, rugged in construction and economical to manufacture.

Other objects and features of the invention are pointed out in the following description in terms of the embodiments thereof which are shown in accompanying drawings. It is to be understood, however, that the drawings are for the purpose of illustration only and that the invention can be embodied otherwise without departing from the general principles thereof.

DESCRIPTION OF THE PREFERRED EMBODIMENTS

Figure 1:
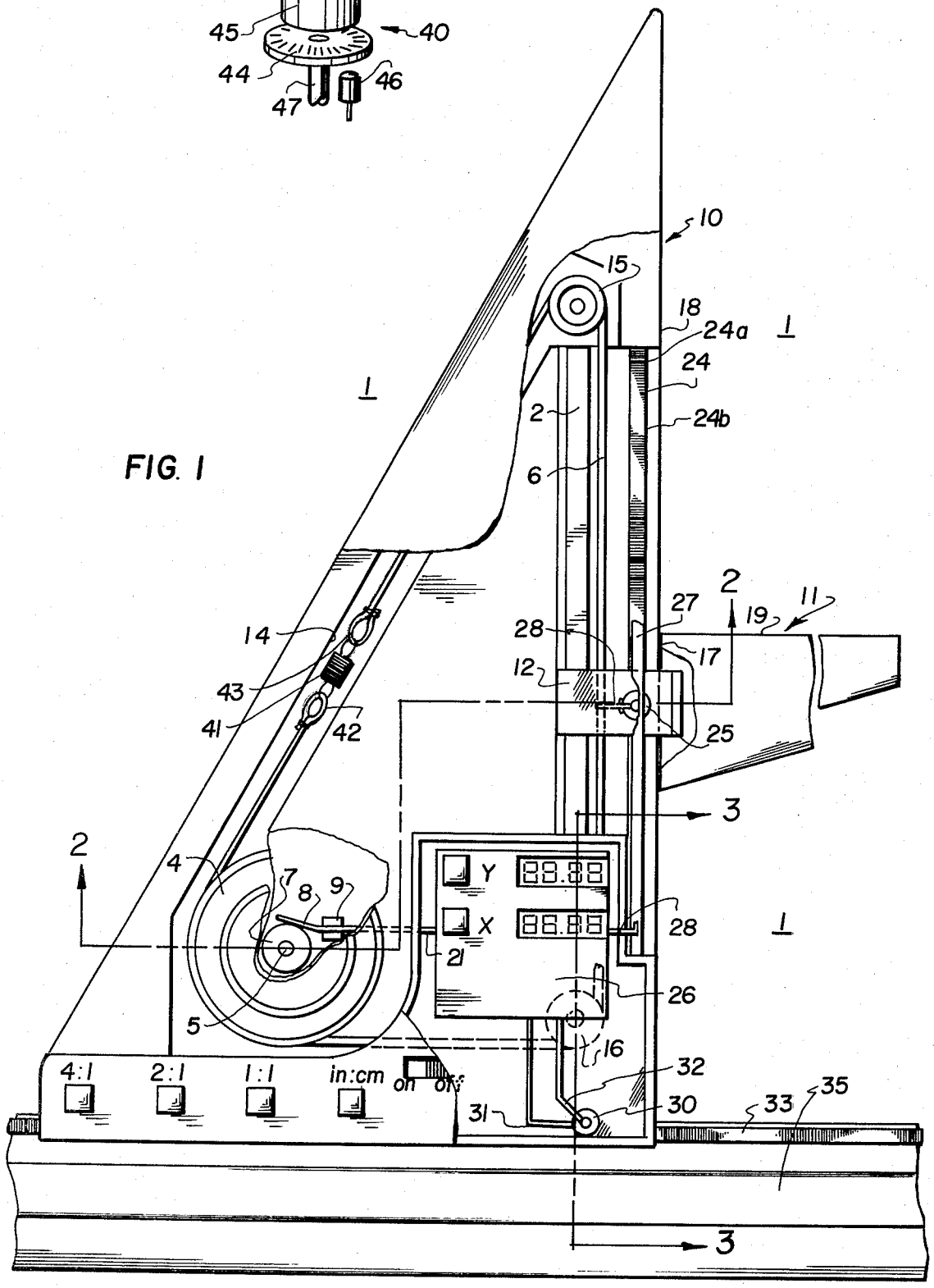
FIG. 1 is a top plan view with portions cut away of one embodiment of the invention.

Referring now in particular to the drawings, a preferred embodiment of the invention is shown in FIG. 1 and comprises a first triangle generally designated 10 having a vertical straight edge 18 and a second triangle generally designated 11 having a horizontal straight edge 19. Second triangle 11 is slidably engaged with the vertical straight edge 18 of the first triangle 10 along its opposite side 17.

Means for driving the second triangle 11 along the vertical straight edge 18 of the first triangle 10 comprise a drive wheel 4 which is rotatably mounted about a pivot axis 5 in the first triangle 10. Pivot axis 5 is shown perpendicular to the drafting surface 1 on which the first triangle 10 is adapted for use. The drive means for second triangle 11 further include guide means here shown in the form of a pair of rollers 15, 16 and a suitably provided slot 14 for accommodating a cable or belt member 6 which is movable therein. Cable or belt member 6 is rapped around the drive roller and guide pulleys or rollers 15 and 16 and has a portion as shown between the guide pulleys 15 and 16 which is coextensive and adjacent the vertical straight edge 18 of the first triangle 10.

Belt or cable 6 may be continuous or endless or may be provided with a tention absorbing spring 41 which is connected between loops 42 and 43 at the respective ends of cable or belt 6. The use and functioning of spring 41 will be described later in the specification.

At a selected location on cable 6 between guide pulleys 15 and 16 a slide member 12 is rigidly connected. Slide member 12 is adapted for sliding engagement in a trackway 2 defined in the first triangle 10. With the rotation of drive wheel 4, slide 12 can slide from the low position near the bottom guide pulley 16 to the top position near the guide pully 15. The motion slide 12 carries the second triangle 11 upwardly and downwardly along the vertical straight edge 18 and moves the vertical position of the horizontal straight edge 19 in accordance with this invention and the inventions disclosed in the two parent applications.

Figure 2:
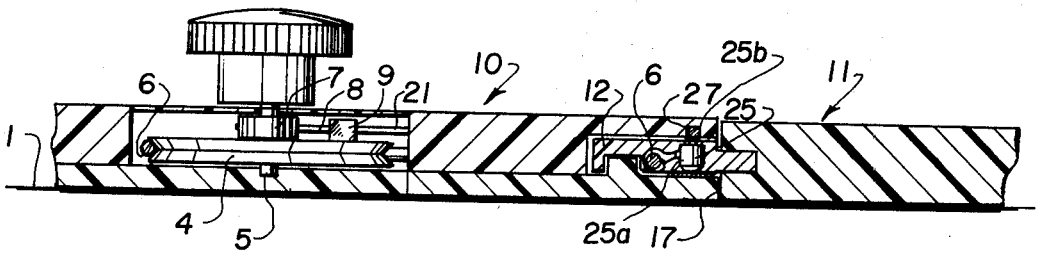
FIG. 2 is a side elevational view taken along lines 2—2 of FIG. 1 showing the drive and optical sensor for the vertically displacable second triangle.

A plurality of equally spaced ruled markings 24 are positioned in the base of the groove 2 adjacent the vertical straight edge 18 and defined in a row in the path of movement of the slide member 12. A first photosensitive element or sensor 25 is embedded the slide member 12 as shown in FIGS. 1 and 2. The first photosensor 25, which may be any photosensitive including infra-red sensing means, is exposed in slide 12 in such a way to face the plurality of ruled markings 24 so that a vertical displacement of the slide member 12 would expose the photosensitive end **25*a* of the photosensor 25 to the passing ruled markings 24. The photosensor 25 is adapted to count the number of passing ruled markings which, for example, may be spaced at intervals of 1/100th of an inch which spacing is only limited by the sensitivity of the photosensor 25. A commercially available example of a member which can be used for the photosensor 25** is the product labeled TIL 609 through TIL 612 available from Texas Instruments Inc. This commercially available element is of sufficiently small size and sufficiently accute sensitivity to infra-red light to provide the desired resolution for distance measurements as required by this invention. Another known infra-emitter and sensor combination, which illuminates the marking and senses their passing is available from Texas Instruments Corp. with catalog number TIL 149.

Figure 6:
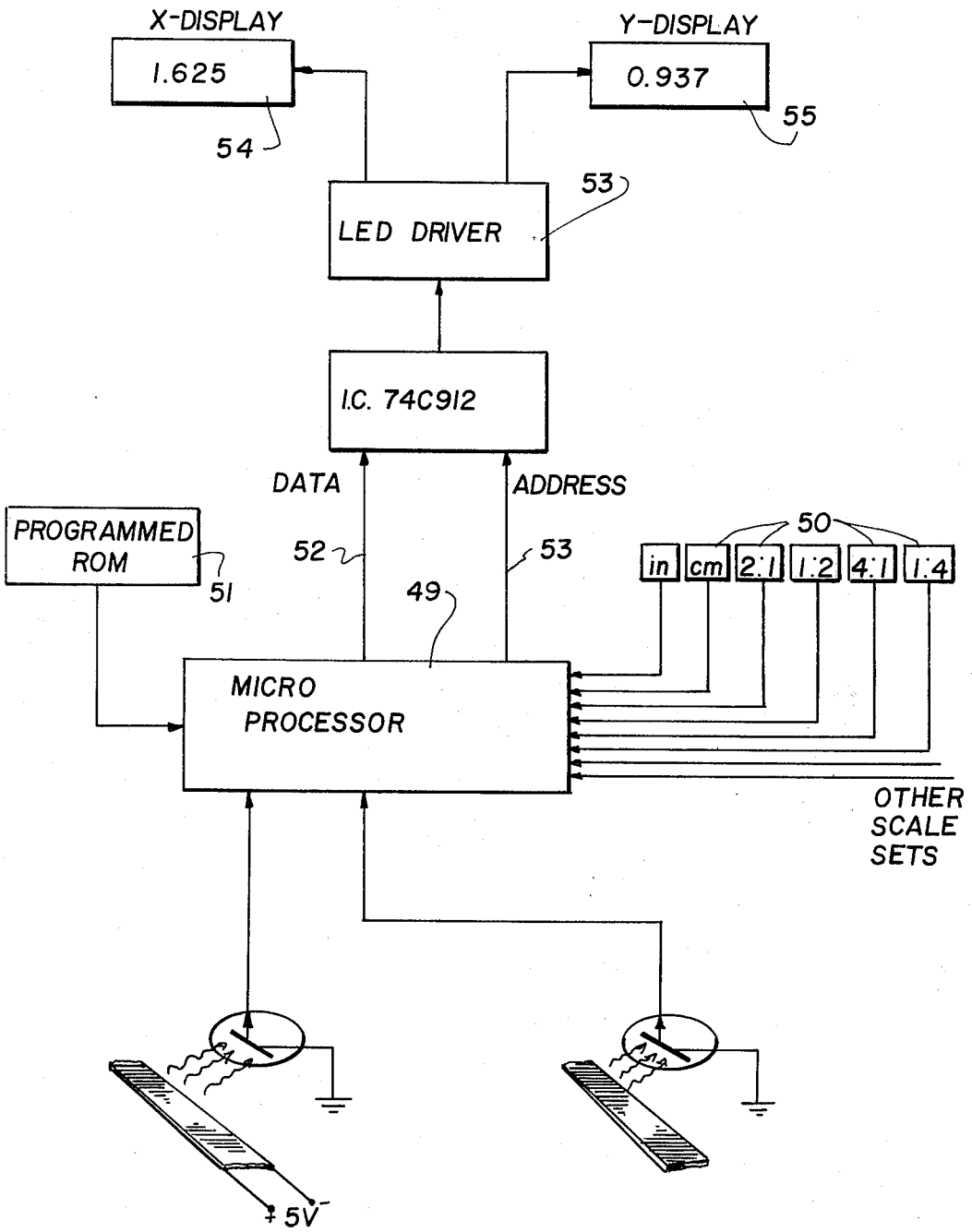

The photosensor 25 with associated apparatus comprises Y-sensing or Y-displacement sensing means of the application and includes a connection to a microprocessor unit which is shown in FIG. 6, later to be described. The continuity or electrical connection of the photosensor 25 to the circuitry of FIG. 6 which physically is disposed in the circuit chip 26 of FIG. 1, is achieved as follows: One contact to the photosensor 25 is achieved through the case of the photosensor by providing a metalic slide 12, made of aluminum or other electrically conductive material. Alternatively a wire 28 may be provided connecting the case of photosensor 25 to the cable 6. In a preferred embodiment of the invention, the cable 6 is metalic and conducts electricity. The continuity between the case of photosensor 25 and cable 6 is therefore achieved either through wire 28 or through the metalic slide member 12. Drive wheel 4 is also made of metalic substance such as aluminum or other electrically conductive material and the electric continuity between metalic cable 6 and the metalic drive wheel 4 is insured by the tention spring 41 which provides a constant and substantial engagement between cable 6 and the drive wheel 4. A particular wire rope or cable 6 which has been found to have sufficient flexibility and strength for the inventive purpose is manufactured by the Bergen Wire Rope Company and is tradenamed Microlin. An unjacketed or uninsulated variety of the metal cable is used to provide the desired electrical continuity.

Continuing the circuit, as shown in FIG. 2, the wheel 4 which is mounted for rotation about the axis pin 5 further includes a metal drum 7 which is in electrical contact with the drive wheel 4. A spring metal contact 8 is biased against the drum 7 and held in this position by posts 9 extending from the first triangle 10. Spring metal contact 8 is connected to the appropriate circuitry 26 by a line or wire 21.

A second contact is required for the photosensor 25 and this, in the commercially available photosensor is positioned at the tail end **25*b* of the photosensor 25. For providing this electrical connection, the first triangle 10 is provided with a metal trackway 27 which is in spring contact with the end 25*b* of the photosensor 25. Trackway 27 is electrically connected, either directly or through wire 29, to the circuitry 26. A complete electrical connection to the two polls of the photosensor 25 is therefore achieved through trackway 27 on the one end and slide member 12, wire rope 6, wheel 4, spring 8 and wire 21** on the other end.

Figure 3:
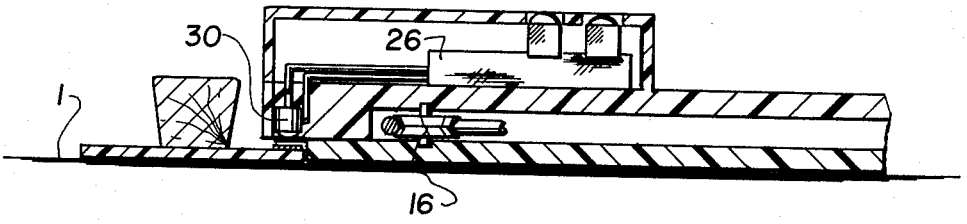
FIG. 3 is a side partial elevational view taken along lines 3—3 of FIG. 1 showing the horizontal measuring displacement apparatus and the physical orientation of the circuitry and digital display members.

A measure of the horizontal distance traveled by the first triangle 10 across the drafting surface 1, and thus a distance traveled by the vertical straight edge 18 is provided by a second light or photosensor 30 which is disposed within the first triangle as seen in FIGS. 1 and 3. Photosensor 30 is connected to circuit 26 by one wire 31 connected between the casing or photosensor 30 and a second wire 32 connected between the exposed pole or tail end of photosensor 30 and circuit 26.

As best seen in FIG. 1, a tape 33 may be provided on a horizontal straight edge 35 which is of conventional design. The tape is provided with a plurality of ruled markings shown which are similar to the plurality of ruled markings 24.

Photosensor 30 may also be a commercially available unit such as Texas Instrument type TIL 149 which is a combination of an infrared-emitting diode and an n-p-n silicon phototransistor. In this case tape 33 does not have to emit infrared. Also no ambient light is needed since infrared is emitted and received by the same unit.

Alternatively, the tape with ruled markings 33 may be provided directly on the drafting surface 1. The ruled markings 33 form a second plurality of ruled markings with the first plurality of ruled markings being at 24. Both ruled markings 24 and 33 are preferably about 0.01 inches apart. Each set of ruled markings is eluminated either by ambient light or by a current means hereinafter to be described. Sensors 30 and 25 are particularly sensitive to infrared and may be provided as infrared sensors. If insufficient ambient light is not provided, for example with the first plurality of ruled markings 24, a current means may be connected to each ruled marking and each ruled marking may be made, for example, a resistive material. A first wire 24*a* and second wire 24*b* may be connected to either side of each ruled marking in 24 and provided with electricity from the circuit means 26. With current flowing through each resistive element of the plurality of ruled markings 24, each element becomes an infrared radiator thus providing an artificial source of infrared to be picked up by sensor 25.

Figure 5:
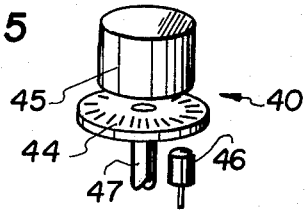
FIG. 5 is a schematic representation of a shaft encoder used in the embodiment of FIG. 4; and, FIG. 6 is a block diagram of circuitry used in accordance with the invention each block of which is a commercially available chip or combination of chips.
Figure 4:
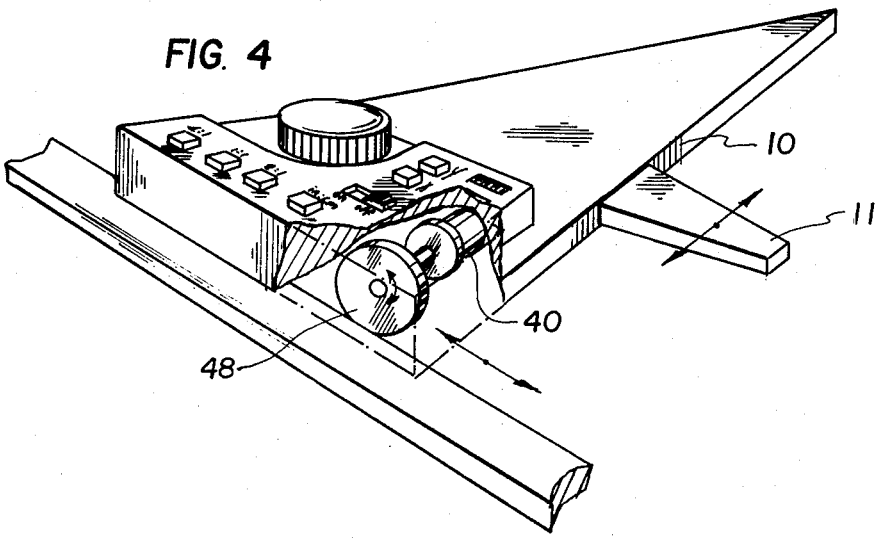
FIG. 4 is a front perspective view of a different embodiment of the invention.

In an alternate embodiment shown in FIG. 4, the second plurality of ruled markings 33 and the second photosensor 30 may be replaced by a shaft encoder 40. The shaft encoder is shown in greater detail at FIG. 5 which shows a disc 44 having a plurality of radially extending circumferentially spaced ruled markings. The housing 45 of the shaft encoder may include a source of infrared radiation such as an infrared emitting diode and the disc 44 may be of transparent material. Opposite to the housing 44 is disposed a photosensor 46 for sensing the passing of the ruled markings 44. The shaft encoder of FIG. 5 thus operates to sense the passing of ruled markings which are disposed on a disc in a way similar to the sensing of the passing of ruled markings 33 which are disposed on a line.

The shaft 47 of shaft encoder 40 is connected to a roller 48 which has a periphery engaged with the drafting surface so that the roller 48 rotates with the horizontal displacement of the first triangle.

In a preferred embodiment of the invention, a shaft encoder can be used, which is commercially available, for example from Vernitech Corp. of New York which manufactures a shaft encoder of the type numbered VGE 11-403. This shaft encoder is of sufficient sensitivity and small size to be particularly suited for the inventive purpose.

The roller 48 is preferrably covered with a high friction synthetic material for insuring a rolling of the roller 48 when the first triangle is moved horizontally across the drafting surface. Such a high friction synthetic material is provided by the Kager International Company and goes under the trade name ANTI-SLIDE.

In a preferred embodiment of the invention, all of the plastic materials may be formed integrally and are preferably made of a thermoplastic material such as the material under the trade name of VALOX provided by the General Electric Corp.

Turning to the digital circuit which is shown graphically at 26 in FIG. 1, attention should be had to FIG. 6. In FIG. 6 the digital circuit is shown which is made of commercially available circuit elements. For example, a microprocessor shown connected to the first and second photosensor elements 30, 25, and 30 respectively, is provided by the Texas Instruments Company and has the catalogue number Intel Number 8279. A plurality of scale selectors is shown at 50 with each scale selector comprising a switch for pre-programming the microprocessor 49. The scale switches may be, for example, for converting from inches to centimeters, for converting scales as shown or for any other scale changing purposes which might be necessary.

A programed ROM 51 is shown for providing a read only memory to the microprocessor and this element can be commercially had and goes under the number ROM 8748. This element, as well, is available from the Texas Instrument Corp.

Microprocessor 49 provides a data at output terminal 51 and an address at output terminal 53 for driving an integrated circuit Texas Instruments Number 74 C 912 which, in turn, drives an LED driver for producing a digital display at X and Y displays shown at 54 and 55 respectively. LED driver 53 is available again from the Texas Instruments Corp. and has the catalogue number IC 8652.

While specific embodiments of the invention have been shown and described in detail to illustrate the application of the principles of the invention, it will be understood that the invention may be embodied otherwise without departing from such principles.

What is claimed is:

1. A Digital Drafting Machine for measuring and displaying a distance on a drafting surface comprising:

a first triangle with a vertical straight edge;

a second triangle with a horizontal straight edge having an adjacent edge slideably engaged with said first triangle along said vertical straight edge;

a drive wheel rotatably mounted in said first triangle;

a cable guide means in said first triangle spaced from said drive wheel;

a cable engaged around said drive wheel and cable guide means having at least a portion coextensive with a portion of said vertical straight edge and adjacent thereto;

said drive wheel rotatable to vertically move said cable portion;

a slide member connected to said cable portion adapted for movement in a path in said first triangle and along said vertical straight edge;

said second triangle connected to said slide member;

a first plurality of spaced ruled markings distributed along said first triangle adjacent said vertical straight edge and in the path of said slide member;

first photosensor means in said slide member facing said first plurality of spaced ruled markings for sensing the passing of said ruled markings with respect to said slide member;

second photosensitive means in said first triangle facing the drafting surface;

a second plurality of spaced ruled markings distributed along a horizontal row on the drafting surface associated with said first triangle;

said first triangle positionable with said second photosensor means facing said second plurality of ruled markings;

said first triangle movable horizontally and said second sensor adapted for sensing the passing of said second plurality of ruled markings;

digital circuit means connected to said first and second photosensor means for converting said sensed passings of said respective ruled markings; and, a digital display connected to said digital circuit means for displaying a digital numeral corresponding to the passing of said respective ruled markings.

2. A drafting machine according to claim 1 wherein said first and second photosensor means both comprise infra-red photosensors.

3. A drafting machine according to claim 2 wherein each of said ruled markings comprises a resistive element, and current means connected to opposite sides of each of said resistive elements for providing a current therethrough whereby each of said resistive elements becomes a source of infra-red radiation.

4. A drafting machine according to claim 1 wherein said first photosensor means comprises a photosensitive diode having two contacts, one contact comprising a case for said diode, said cable comprising a metal wire rope, said drive wheel and said slide both made of conductive material, said drive wheel including a metal drum, a spring metal contact connected to said first triangle and biased to bare against said metal drum, said spring metal contact connected to said circuit means for providing a first path of continuity from said diode case through said slide, cable and drive wheel.

5. A drafting machine according to claim 4 wherein said diode further includes a tail end acting as a second contact, a wire trackway defined in said first triangle and along the path of said slide member, said tail end engaged with said wire trackway, said wire trackway connected to said circuit means for providing a second continuity path for said diode.

6. A drafting machine according to claim 4 further including a spring connected into said wire rope for maintaining a tension on said wire rope and providing a tension between said wire rope and said drive wheel.

7. A drafting machine according to claim 1 wherein said guide means comprises a first and second pully rotatably mounted in said first triangle at adjacent angles thereof on either side of said vertical straight edge, said drive wheel rotatably mounted at an edge of said first triangle opposite from said vertical straight edge.

8. A digital drafting machine for measuring and displaying a distance on a drafting surface comprising:

a first triangle with a vertical straight edge;

a second triangle with a horizontal straight edge having an adjacent edge slideably engaged with said first triangle along said vertical straight edge;

a drive wheel rotatably mounted in said first triangle;

a cable guide means in said first triangle spaced from said drive wheel;

a cable engaged around said drive wheel and cable guide means having at least a portion coextensive with a portion of said vertical straight edge and adjacent thereto;

said drive wheel rotatable to vertically move said cable portion;

a slide member connected to said cable portion adapted for movement in a path in said first triangle and along said vertical straight edge;

said second triangle connected to said slide member;

a first plurality of spaced ruled markings distributed along said first triangle adjacent said vertical straight edge and in the path of said slide member;

first photosensor means in said slide member facing said first plurality of spaced ruled markings for sensing the passing of said ruled markings with respect to said slide member;

a roller rotatably mounted in said first triangle on an axis parallel to the plane of the drafting surface hacing a portion engaged with the drafting surface;

a shaft encoder connected to said roller for providing digital information corresponding to the rolling of said roller, said roller being rotated when said first triangle is moved horizontally across the drafting surface; and digital circuit means connected to said first photosensor means and said shaft encoder for displaying a digital number corresponding to the passing of said ruled markings and the rotation of said shaft encoder.

9. A drafting machine according to claim 8 wherein said first plurality of ruled markings are approximately 0.01 inches apart.

10. A drafting machine according to claim 8 wherein said first photosensor means comprises an infra-red photosensor, and current means connected to each of said ruled markings for providing a current therethrough, each of said ruled markings comprising a resistive element whereby ultraviolet infra-red radiation is emitted from each of said ruled markings when a current is passes therethrough for activating said infra-red photosensor.

11. A drafting machine according to claim 8 wherein said roller has a periphery covered with an anti-slip plastic.

12. A drafting machine according to claim 8 wherein said first triangle is made of teflon filled Valox for better movement on the drafting surface.

13. A drafting machine according to claim 8 wherein said first photosensor means comprises a unit of an infra-red-emitting diode and an n-p-n silicon phototransistor for emitting and receiving infrared with said same unit thereby necessitating no ambient light.

* * * * *